US007082707B2

(12) United States Patent
Poot

(10) Patent No.: US 7,082,707 B2
(45) Date of Patent: Aug. 1, 2006

(54) SUPPORT TRUSS FOR A MESSAGING SIGN

(75) Inventor: Aaron C. Poot, Mishawaka, IN (US)

(73) Assignee: Valmont Industries, Inc., Valley, NE (US)

( * ) Notice: Subject to any disclaimer, the term of this patent is extended or adjusted under 35 U.S.C. 154(b) by 163 days.

(21) Appl. No.: 10/715,044

(22) Filed: Nov. 17, 2003

(65) Prior Publication Data

US 2005/0102873 A1 May 19, 2005

(51) Int. Cl.
*G09F 7/00* (2006.01)

(52) U.S. Cl. ..... 40/612; 40/606.01; 40/606.14; 52/38; 52/693; 52/633

(58) Field of Classification Search ..... 40/612, 40/606.01, 606.14, 624; 248/219.1; 52/38, 52/693, 633
See application file for complete search history.

(56) References Cited

U.S. PATENT DOCUMENTS 3,120,069 A * 2/1964 Pfaff, Jr. et al. ..... 40/624
3,159,243 A * 12/1964 Leonard ..... 182/150
3,564,783 A * 2/1971 Dunne ..... 52/38
3,952,978 A * 4/1976 Reinitz ..... 246/477
4,015,349 A * 4/1977 Dunne ..... 40/473
5,008,967 A * 4/1991 Barrios et al. ..... 14/7
5,517,393 A * 5/1996 Townsend et al. ..... 362/233
6,189,839 B1 * 2/2001 Lemieux ..... 246/293
6,408,587 B1 * 6/2002 Cronin et al. ..... 52/637
6,892,502 B1 * 5/2005 Hubbell et al. ..... 52/633
2004/0123501 A1 * 7/2004 Safavi et al. ..... 40/452
2004/0128891 A1 * 7/2004 Keach ..... 40/624

* cited by examiner

*Primary Examiner*—Gary C. Hoge
(74) *Attorney, Agent, or Firm*—Thomte, Mazour & Niebergall; Dennis L. Thomte

(57) ABSTRACT

A support truss for a messaging sign comprising an elevated box truss which extends over a roadway and which has its opposite ends secured to upstanding supports. The box truss is comprised of a plurality of box truss sections secured to one another in an end-to-end relationship with at least one of the box truss sections adapted to have one or more messaging signs mounted therein. The messaging signs are horizontally slidably adjustably mounted on the box truss section so that the box truss section can accommodate signs having various thicknesses. The box truss in which the messaging sign is mounted is designed so that the face of the sign is unobstructed to permit motorists to readily observe the messages on the sign. A walkway is provided within the truss rearwardly of the messaging sign.

22 Claims, 6 Drawing Sheets

SUPPORT TRUSS FOR A MESSAGING SIGN

BACKGROUND OF THE INVENTION

1. Field of the Invention

This invention relates to a support truss for a messaging sign and more particularly to a support truss which extends over a roadway and which is adapted to have Variable Messaging Signs (VMS) or Digital Messaging Signs (DMS) mounted therein which are utilized to advise motorists of traffic conditions, road conditions, Amber alerts, etc.

2. Description of the Prior Art

VMS and DMS signs have varying thicknesses, lengths and heights. Heretofore, the signs, when positioned over a roadway, were positioned at the forward side of a supporting truss. A walkway was normally provided at the face side of the signs with the walkways only being accessible by a bucket truck or a ladder, which presented a traffic hazard and a dangerous work area for the person or persons servicing the signs.

SUMMARY OF THE INVENTION

A support truss for messaging signs such as VMS or DMS signs is provided for supporting the sign or signs over a roadway to alert motorists of traffic conditions, road conditions, Amber alerts, etc. The support truss comprises an elongated, elevated box truss which extends over the roadway and which has its opposite ends secured to upstanding supports. The box truss is comprised of a plurality of box truss sections secured to one another in an end-to-end relationship. At least one of the box truss sections is adapted to have a messaging sign mounted therein. All of the box truss sections, except the box truss sections having the messaging sign or signs mounted therein, comprise horizontally spaced-apart first and second upper tubes and horizontally spaced-apart first and second lower tubes, first truss members interconnecting the first and second upper tubes, second truss members interconnecting the first and second lower tube members, third truss members interconnecting the second upper tube and the second lower tube, and fourth truss members interconnecting the first upper tube and the first lower tube. The box truss section which supports the messaging signs therein comprises first and second upper tubes, first and second lower tubes, first truss members interconnecting the first and second upper tubes, second truss members interconnecting the first and second lower tubes, and third truss members interconnecting the second upper tube and the second lower tube. The messaging sign is mounted in the box truss section as described so that the sign is positioned between the first upper tube, the first lower tube, the first truss members, the second truss members, and the third truss members of the associated box truss so that oncoming motorists may observe messages on the front or face side of the messaging sign. The messaging sign has a majority of its depth positioned within the truss section. The messaging sign is selectively horizontally adjustably mounted on the box truss section to enable the box truss section to accommodate signs having various depths. A walkway extends from one end of the support truss to behind the sign or signs to enable workers to conveniently and safely service the messaging sign or signs.

It is therefore a principal object of the invention to provide a unique truss section which is especially designed to accommodate multiple Variable Messaging Signs (VMS) and Digital Messaging Signs (DMS) simultaneously.

Still another object of the invention is to provide a truss section of the type described which is designed to permit the signs to mount internally in the truss.

Still another object of the invention is to provide a truss bracing system which simultaneously accommodates multiple sign depths by adjustably sliding the signs with respect to the truss section.

Still another object of the invention is to provide a sign truss which provides a safe working platform within the sign structure truss.

Yet another object of the invention is to provide a truss of the type described which allows unobstructed walkway access to the signs within the sign structure truss.

Still another object of the invention is to provide a truss section for accommodating messaging signs wherein the face of the signs are unobstructed so that motorists may observe the messages thereon.

These and other objects will be obvious to those skilled in the art.

DETAILED DESCRIPTION OF THE INVENTION

Figure 1:
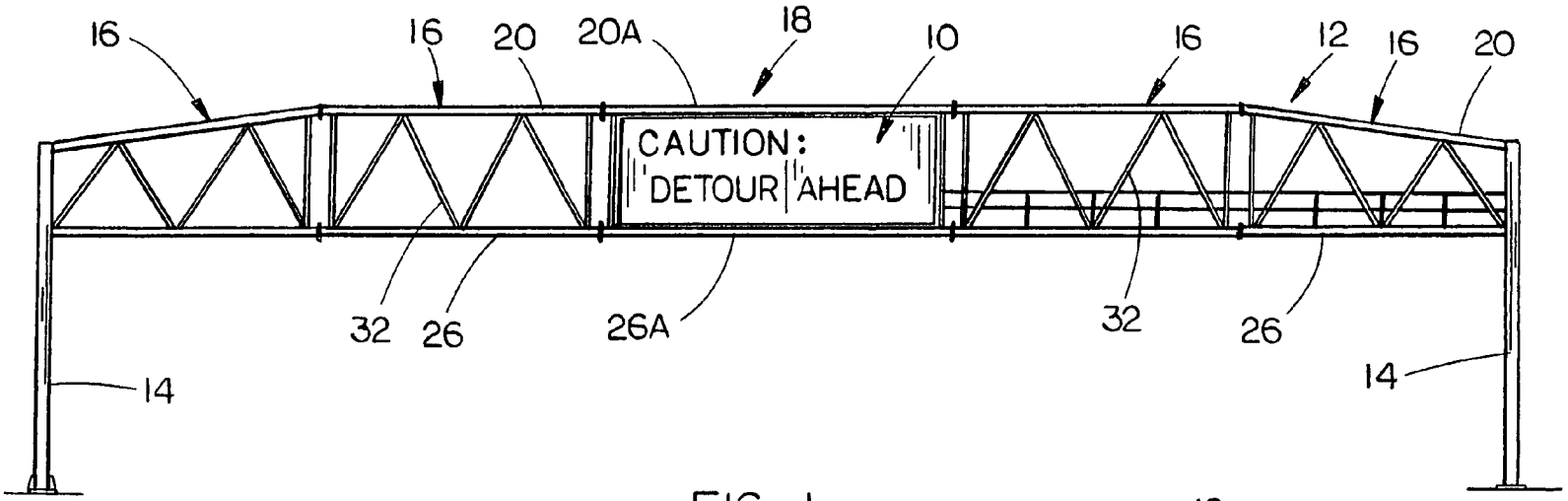
FIG. 1 is a a front elevational view of the support truss of this invention.
Figure 2:
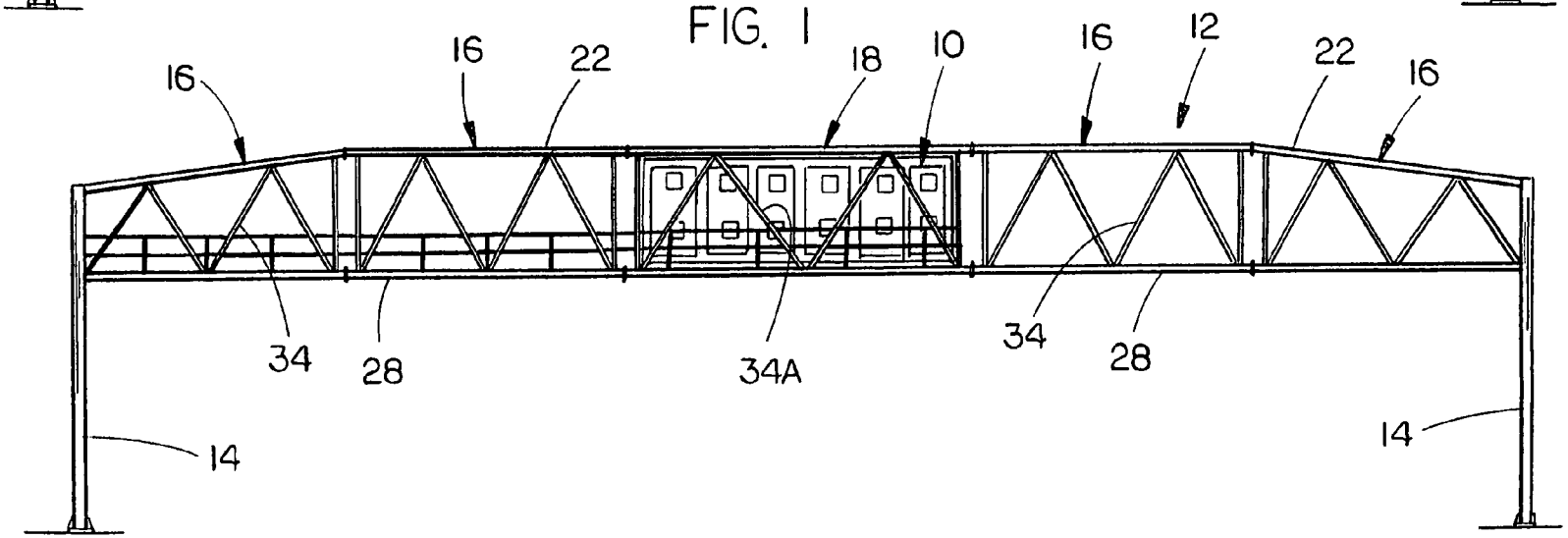
FIG. 2 is a rear elevational view of the support truss of this invention.
Figure 3:
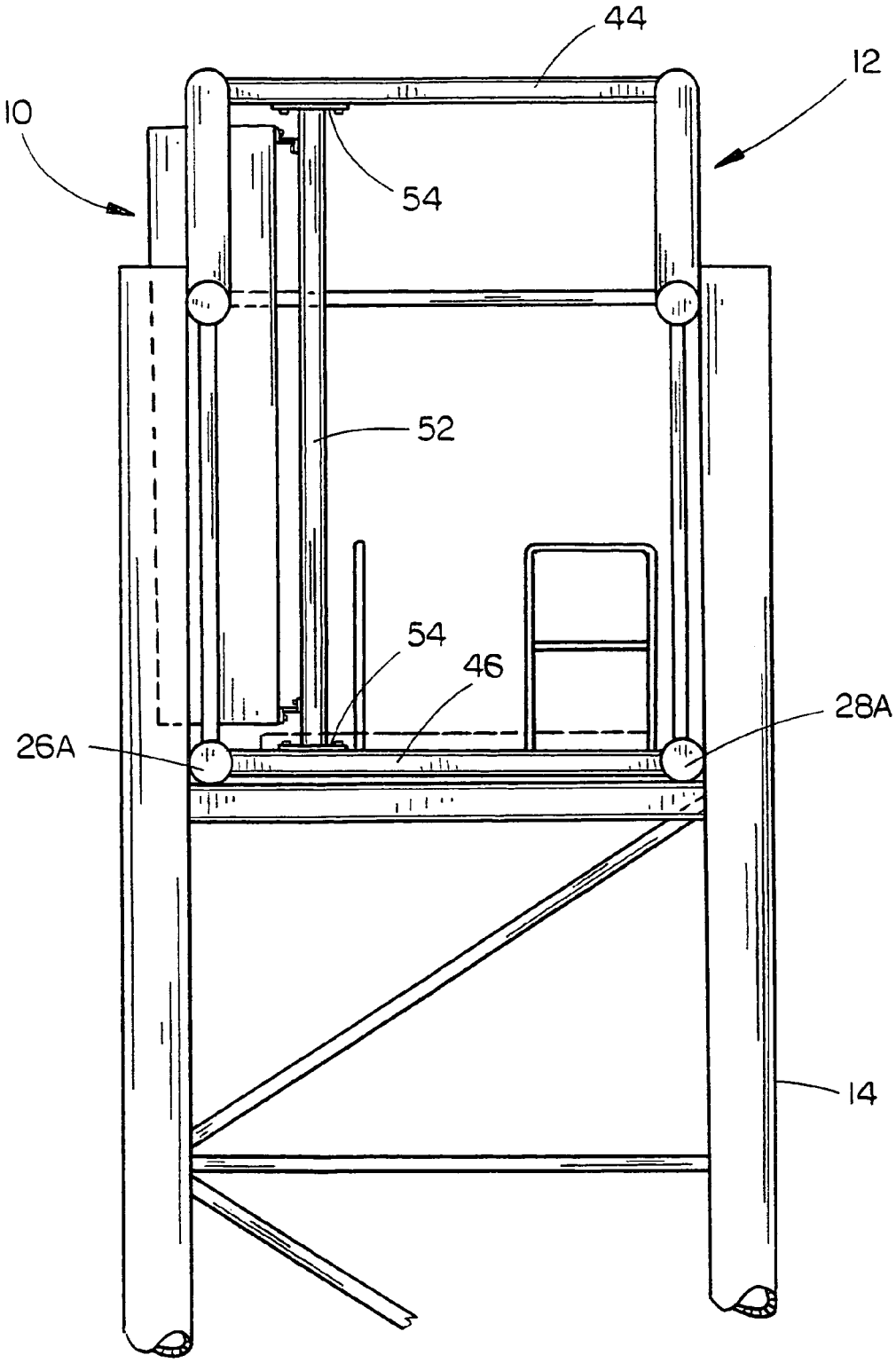
FIG. 3 is a partial end elevational view of the support truss of this invention as seen from the right side of FIG. 1.
Figure 4:
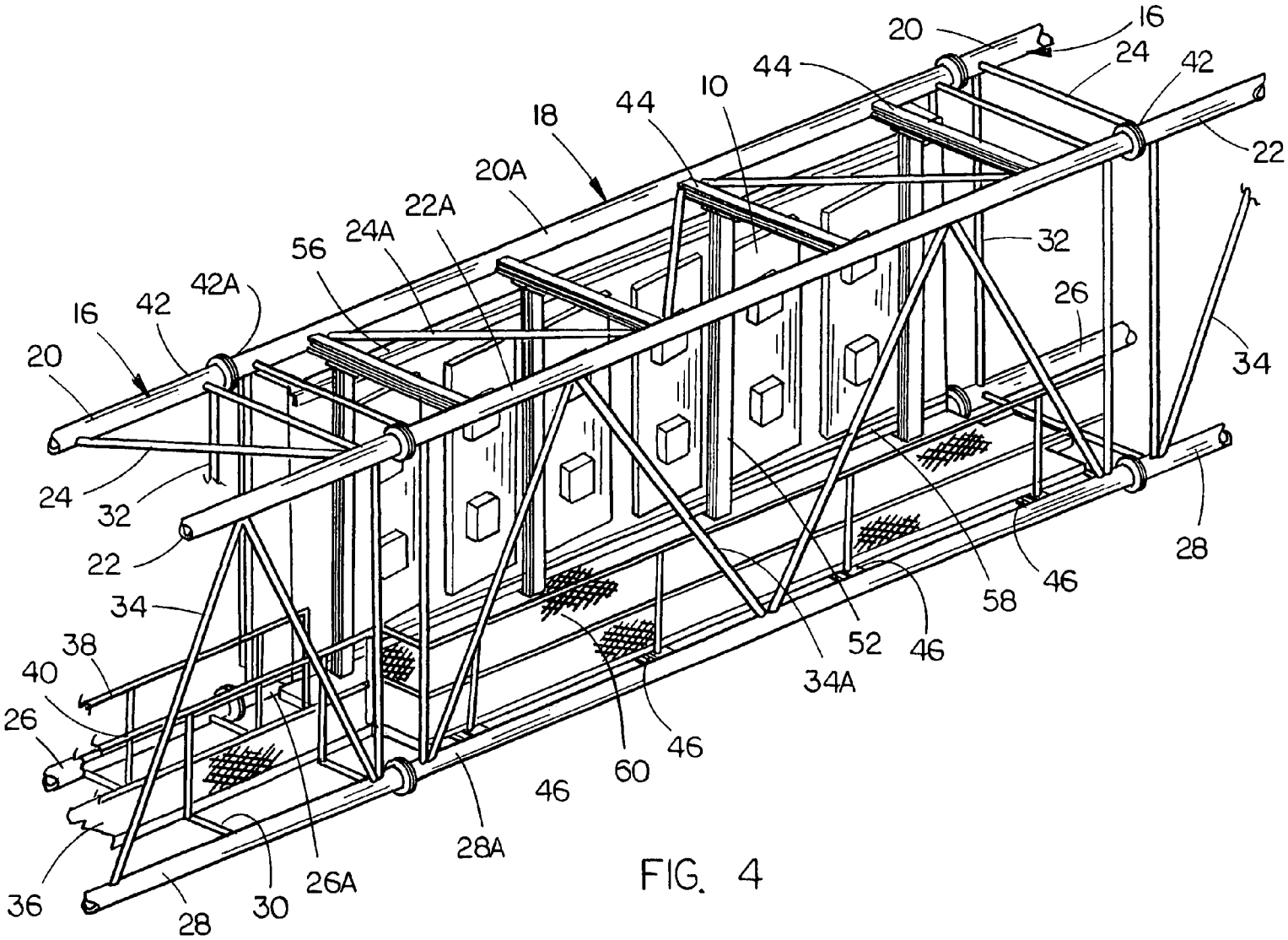
FIG. 4 is a partial rear perspective view of the support truss of this invention.
Figure 5:
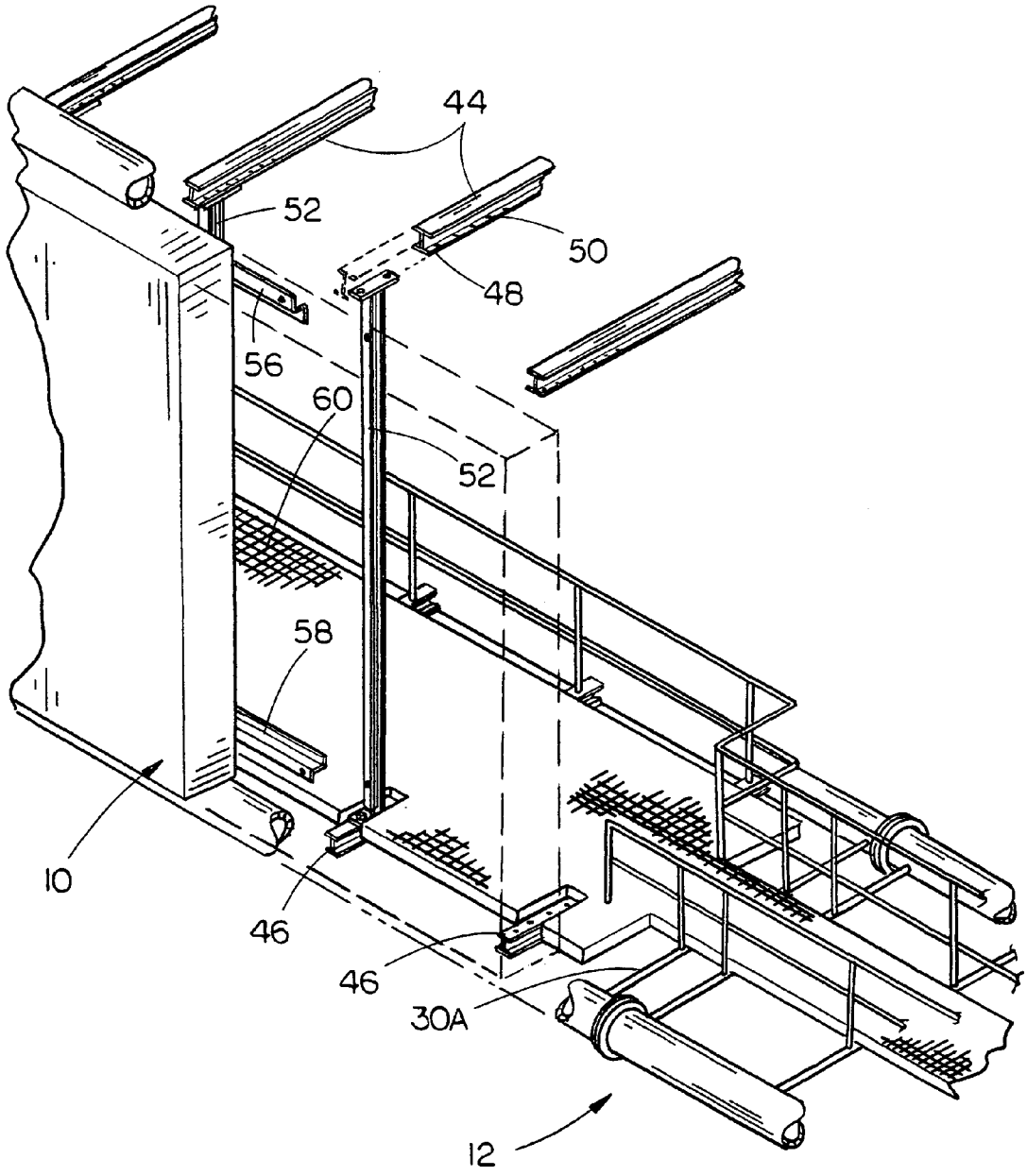
FIG. 5 is a partial front exploded perspective view of the support truss of this invention.
Figure 6:
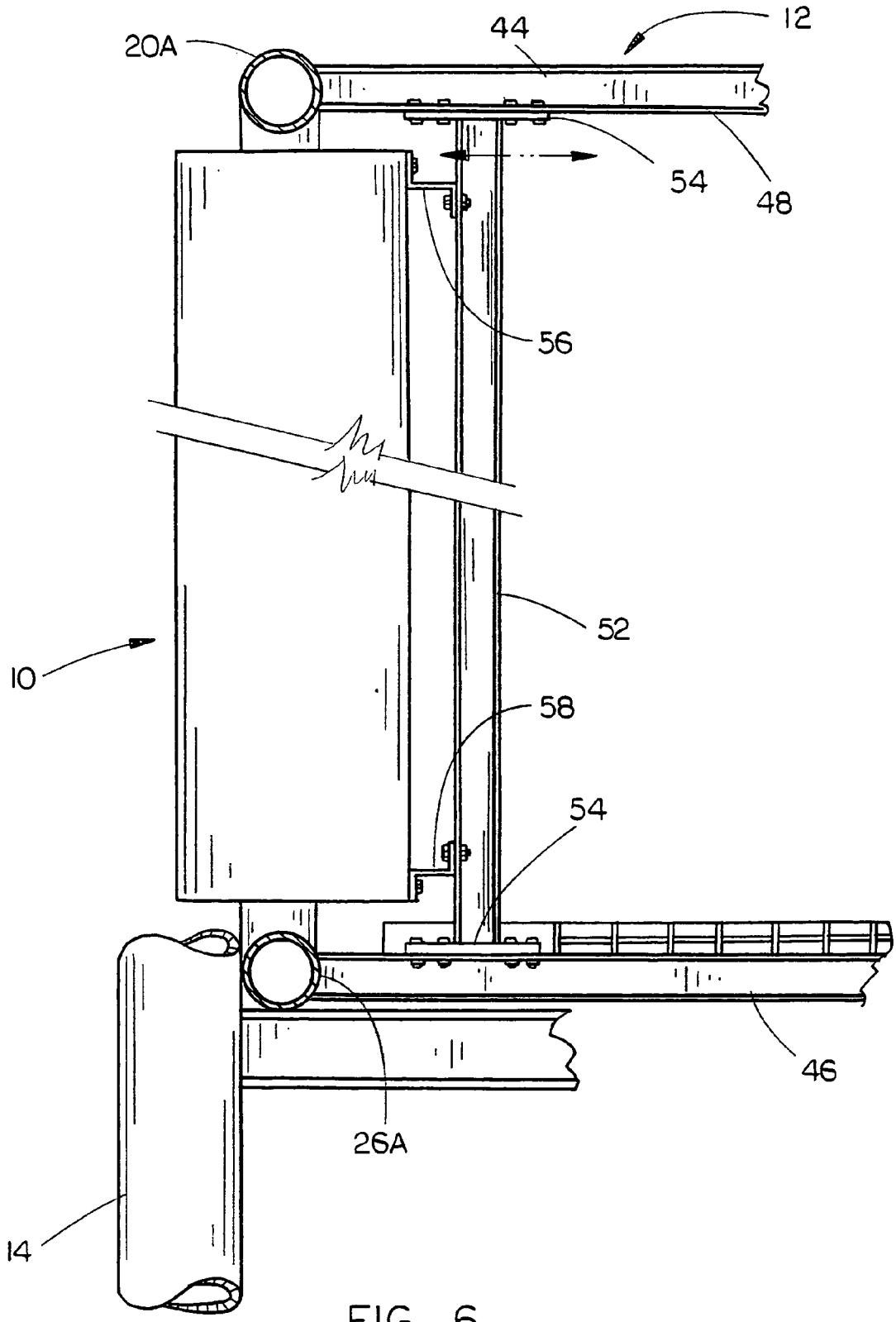
FIG. 6 is a partial vertical sectional view of the support truss of this invention.
Figure 7:
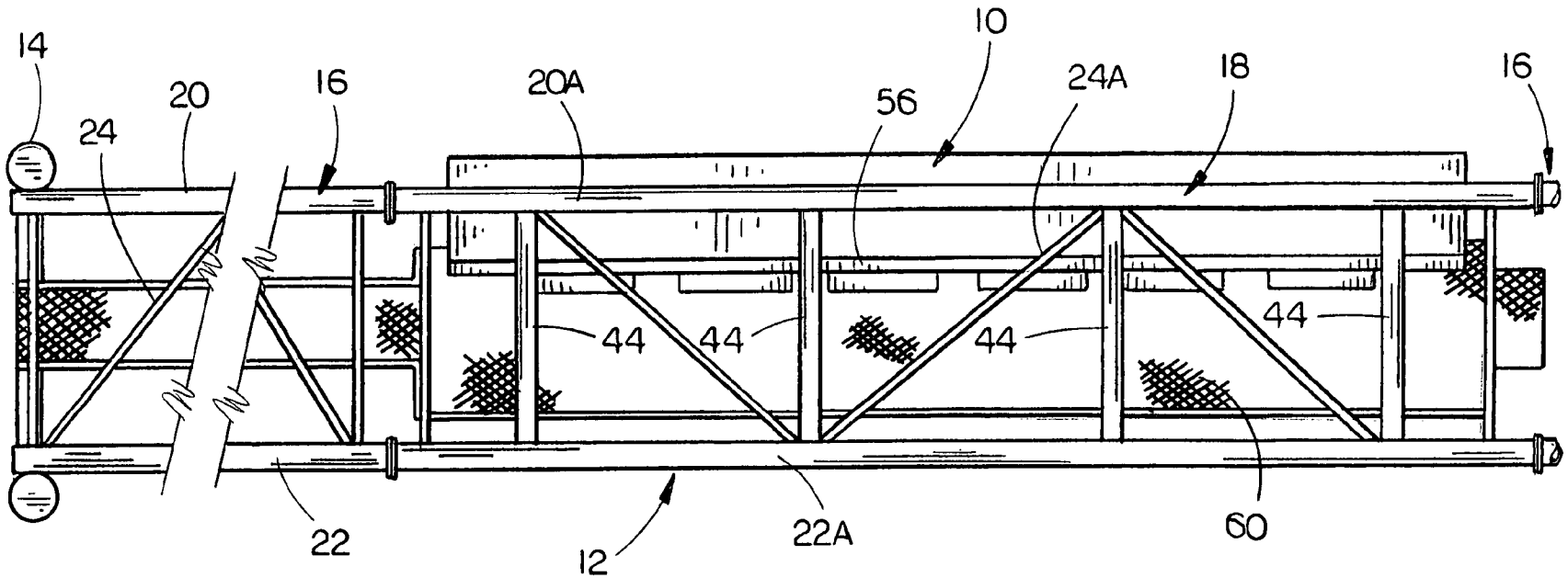
FIG. 7 is a partial top view of the support truss of this invention.

The numeral 10 refers to conventional Variable Messaging Signs (VMS) or Digital Messaging Signs (DMS) which are utilized to advise motorists of traffic conditions, road conditions, Amber alerts, etc. The VMS and DMS signs 10 have varying thicknesses, lengths and heights. Heretofore, the signs, when positioned over a roadway, were positioned at the forward side of a truss. A walkway was normally provided at the face side of the signs. Normally, the walkways were accessible only by a bucket truck or a ladder, which presented a traffic hazard.

In the present invention, the sign(s) 10 are positioned over a roadway by means of a box truss 12 which is supported at its opposite ends by suitable supports 14. Truss 12 is normally comprised of a plurality of truss sections 16 connected together in an end-to-end manner. The truss section, in which is positioned the sign 10, will be referred to generally by the reference numeral 18. In some cases, more than one truss section 18 will be utilized.

For purposes of description, each of the truss sections 16 will be described as including a pair of horizontally spaced upper tubes 20 and 22 which have truss members 24 secured thereto and extending therebetween. Truss section 16 also includes horizontally spaced lower tubes 26 and 28 which have truss members 30 secured thereto and extending therebetween. Truss members 32 are secured to and extend between tubes 20 and 26 while truss members 34 are secured to and extend between tubes 22 and 28. Walkway 36 is positioned upon truss members 30 within truss sections 16. Safety rails 38 and 40 are preferably positioned on opposite sides of walkway 36 within the truss sections 16 for safety purposes. The ends of tubes 20, 22, 26 and 28 which abut an adjacent truss section are provided with connector flanges 42 to enable the truss sections to be connected together by bolts or the like. For aesthetic purposes, the tubes 20 and 22, on the end truss sections 16, extend upwardly and outwardly from the supports 14.

Truss section 18 includes upper tubes 20A, 22A and lower tubes 26A, 28A. Truss members 24A are secured to and extend between tubes 20A and 22A. Truss members 30A are secured to and extend between tubes 26A and 28A. Truss members 34A are secured to and extend between tubes 22A and 28A. A plurality of spaced-apart I-beams 44 are secured to and extend between tubes 20A and 22A in a transverse relationship thereto. A plurality of spaced-apart I-beams 46 are secured to and extend between tubes 26A and 28A in a transverse relationship thereto. The lower flanges 48 of each of the I-beams 44 are provided with a plurality of spaced-apart bolt openings 50 formed therein. The upper flange of each of the I-beams 46 is also provided with spaced-apart bolt openings formed therein. An I-beam 52, having a connector plate 54 at its upper and lower ends, is selectively secured to I-beams 44 and each I-beam 46 by means of bolts extending through connector plate 54, through bolt openings 50 in flange 48 of the I-beam 44 and by means of bolts extending through the connector plate 54 on the lower end of the I-beam 46 and through the bolt openings in the upper flange of the I-beam 46.

A pair of vertically spaced-apart and horizontally extending Z-channels or braces 56 and 58 are secured to the back side of the sign 10 and are secured to the I-beams 52. The I-beams 52 are horizontally adjustably secured to the I-beams 44 and 46 to compensate for different thicknesses of the sign 10 so that the front face of the sign protrudes slightly outwardly of the tubes 20A and 26A. There are no truss members corresponding to truss members 32 which extend between the tubes 20A and 26A so that the face of the sign is unobstructed. Once the sign 10 is properly positioned, the walkway 60 is placed on and secured to the truss members 30A. Safety guard rail 62 is then installed.

Thus, the sign 10 is positioned substantially within the truss 12 and is completely accessible to a worker who is safely within the truss. The sign 10 is accessible without a bucket truck. Since the worker who may service the sign is within the truss as opposed to being positioned on a walkway in front of the sign in the prior art devices, the worker is much safer. Further, the support truss of this invention makes it more convenient.

Thus, it can be seen that the invention accomplishes at least all of its stated objectives.

I claim:

1. In combination:

an elevated box truss extending over a roadway and having opposite ends secured to upstanding supports;

said box truss being comprised of a plurality of box truss sections secured to one another in an end-to-end relationship;

at least one of said box truss sections adapted to have a messaging sign mounted therein;

all of said box truss sections, except the said one box truss section, comprising horizontally spaced-apart first and second upper tubes and horizontally spaced-apart first and second lower tubes, first truss members interconnecting said first and second upper tubes, second truss members interconnecting said first and second lower tube members, third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

a messaging sign mounted in said one box truss section;

said messaging sign having a front side, a back side, an upper end, a lower end, and opposite sides;

said upper end of said messaging sign being positioned below said first upper tube of said one box truss section;

said lower end of said messaging sign being positioned above said first lower tube of said one box truss section;

said messaging sign being positioned between said first upper tube, said first lower tube, said first truss members, said second truss members, and said third truss members so that oncoming motorists may observe messages on said front side thereof.

2. The combination of claim 1 wherein said messaging sign comprises a Variable Messaging Sign.

3. The combination of claim 1 wherein said messaging sign comprises a Digital Messaging Sign.

4. The combination of claim 1 wherein said messaging sign comprises a Variable Messaging Sign and a Digital Messaging Sign.

5. The combination of claim 1 wherein said messaging sign is selectively horizontally adjustably mounted on said one box truss section to enable said one box truss section to accommodate signs having varying depths.

6. The combination of claim 1 wherein said one truss section has a walkway mounted therein which is positioned at said back side of said sign.

7. The combination of claim 1 wherein said truss sections have a walkway provided therein.

8. In combination with a messaging sign having a front side, a back side, an upper end, a lower end, and opposite ends, comprising:

an elevated box truss extending over a roadway and having opposite ends secured to upstanding supports;

said box truss being comprised of a plurality of box truss sections secured to one another in an end-to-end relationship;

at least one of said box truss sections adapted to have the messaging sign mounted thereon;

all of said box truss sections, except said one box truss section, comprising horizontally spaced-apart first and second upper tubes and horizontally spaced-apart first and second lower tubes, first truss members interconnecting said first and second upper tubes, second truss members interconnecting said first and second lower tube members; third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

said messaging sign adapted to be positioned between said first upper tube, said first lower tube, said first truss members, said second truss members, and said third truss members so that oncoming motorists may observe messages on said front side thereof;

said upper end of said messaging sign being positioned below said first upper tube of said one box truss section;

said lower end of said messaging sign being positioned above said first lower tube of said one box truss section.

9. The combination of claim 8 wherein the messaging sign comprises a Variable Messaging Sign.

10. The combination of claim 8 wherein the messaging sign comprises a Digital Messaging Sign.

11. The combination of claim 8 wherein the messaging sign comprises a Variable Messaging Sign and a Digital Messaging Sign.

12. The combination of claim 8 wherein the messaging sign is selectively horizontally adjustably mounted on said one box truss section to enable said one box truss section to accommodate signs having varying depths.

13. The combination of claim 8 wherein said one truss section has a walkway mounted therein which is positioned at said back side of the sign.

14. The combination of claim 8 wherein said truss sections have a walkway provided therein.

15. In combination:

an elevated box truss extending over a roadway and having opposite ends secured to upstanding supports;

said box truss being comprised of a plurality of box truss sections secured to one another in an end-to-end relationship;

at least one of said box truss sections adapted to have a messaging sign mounted therein;

all of said box truss sections, except the said one box truss section, comprising horizontally spaced-apart first and second upper tubes and horizontally spaced-apart first and second lower tubes, first truss members interconnecting said first and second upper tubes, second truss members interconnecting said first and second lower tube members, third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

a messaging sign mounted in said one box truss section;

said messaging sign having a front side, a back side, an upper end, a lower end, and opposite sides;

said messaging sign being positioned between said first upper tube, said first lower tube, said first truss members, said second truss members, and said third truss members so that oncoming motorists may observe messages on said front side thereof;

a plurality of horizontally spaced-apart first supports secured to and extending between said first and second upper tubes;

and a plurality of horizontally spaced-apart second supports secured to and extending between said first and second lower tubes;

said sign being selectively adjustably secured to said first and second supports.

16. The combination of claim 15 wherein sign supports are selectively adjustably secured to said first and second supports; said sign supports being secured to said messaging sign.

17. The combination of claim 16 wherein said sign supports are secured to said back side of said messaging sign.

18. In combination:

an elevated box truss extending over a roadway and having opposite ends secured to upstanding supports;

said box truss being comprised of a plurality of box truss sections secured to one another in an end-to-end relationship;

at least one of said box truss sections adapted to have a messaging sign mounted therein;

all of said box truss sections, except the said one box truss section, comprising horizontally spaced-apart first and second upper tubes and horizontally spaced-apart first and second lower tubes, first truss members interconnecting said first and second upper tubes, second truss members interconnecting said first and second lower tube members, third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

a messaging sign mounted in said one box truss section;

said messaging sign having a front side, a back side, an upper end, a lower end, and opposite sides;

said messaging sign being positioned between said first upper tube, said first lower tube, said first truss members, said second truss members, and said third truss members so that oncoming motorists may observe messages on said front side thereof;

said messaging sign having a majority of its depth, between said front and back side, positioned within said one truss section.

19. In combination with a messaging sign having a front side, a back side, an upper end, a lower end, and opposite ends, comprising:

an elevated box truss extending over a roadway and having opposite ends secured to upstanding supports;

said box truss being comprised of a plurality of box truss sections secured to one another in an end-to-end relationship;

at least one of said box truss sections adapted to have the messaging sign mounted thereon;

all of said box truss sections, except said one box truss section, comprising horizontally spaced-apart first and second upper tubes and horizontally spaced-apart first and second lower tubes, first truss members interconnecting said first and second upper tubes, second truss members interconnecting said first and second lower tube members; third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

said messaging sign adapted to be positioned between said first upper tube, said first lower tube, said first truss members, said second truss members, and said third truss members so that oncoming motorists may observe messages on said front side thereof;

a plurality of horizontally spaced-apart first supports secured to and extending between said first and second upper tubes;

and a plurality of horizontally spaced second supports secured to and extending between said first and second lower tubes;

said sign being selectively longitudinally adjustably secured to said first and second supports.

20. The combination of claim 19 wherein sign supports are selectively adjustably secured to said first and second supports; said sign supports being secured to said messaging sign.

21. The combination of claim 20 wherein said sign supports are secured to said back side of said messaging sign.

22. In combination with a messaging sign having a front side, a back side, an upper end, a lower end, and opposite ends, comprising:

an elevated box truss extending over a roadway and having opposite ends secured to upstanding supports;

said box truss being comprised of a plurality of box truss sections secured to one another in an end-to-end relationship;

at least one of said box truss sections adapted to have the messaging sign mounted thereon;

all of said box truss sections, except said one box truss section, comprising horizontally spaced-apart first and second upper tubes and horizontally spaced-apart first and second lower tubes, first truss members interconnecting said first and second upper tubes, second truss members interconnecting said first and second lower tube members; third truss members interconnecting said second upper tube and said second lower tube, and fourth truss members interconnecting said first upper tube and said first lower tube;

said one box truss section comprising horizontally spaced-apart first and second upper tubes, horizontally spaced-apart first and second lower tubes, first truss members interconnecting said first and second upper tubes, second truss members interconnecting said first and second lower tubes, and third truss members interconnecting said second upper tube and said second lower tube;

said messaging sign adapted to be positioned between said first upper tube, said first lower tube, said first truss members, said second truss members, and said third truss members so that oncoming motorists may observe messages on said front side thereof;

said messaging sign having a majority of its depth, between the front side and back side thereof, positioned within the said one box truss section.

* * * * *